US010772430B2

(12) United States Patent
Frankel et al.

(10) Patent No.: US 10,772,430 B2
(45) Date of Patent: Sep. 15, 2020

(54) TWO-PERSON FOLDING CHAIR

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 16/196,634

(22) Filed: Nov. 20, 2018

(65) Prior Publication Data

US 2020/0154891 A1 May 21, 2020

(51) Int. Cl.

| | |
|---|---|
| ***A47C 4/28*** | (2006.01) |
| ***A47C 5/10*** | (2006.01) |
| *A47C 7/00* | (2006.01) |

(52) U.S. Cl.

CPC ..... *A47C 4/283* (2013.01); *A47C 5/10* (2013.01); *A47C 7/002* (2013.01)

(58) Field of Classification Search

CPC .. A47C 4/28; A47C 4/283; A47C 4/30; A47C 1/14

USPC ..... 297/16.1, 45, 55, 56, 59

See application file for complete search history.

(56) References Cited

U.S. PATENT DOCUMENTS

| | | | | | |
|---|---|---|---|---|---|
| 2,096,237 | A * | 10/1937 | Frey | A47C 4/283 | 297/45 |
| 5,570,928 | A * | 11/1996 | Staunton | A47C 4/283 | 297/232 |
| 5,873,624 | A * | 2/1999 | Simpson | A47C 4/283 | 297/173 |
| 6,450,161 | B1 * | 9/2002 | Izumi | F24C 1/16 | 126/9 R |
| 9,775,438 | B1 * | 10/2017 | Schulenberg | A47C 4/283 | |
| 10,362,875 | B2 * | 7/2019 | Grace | A47C 4/283 | |
| 2010/0187866 | A1 * | 7/2010 | Chen | A47C 4/283 | 297/16.1 |
| 2013/0106145 | A1 * | 5/2013 | Chen | A47C 4/283 | 297/42 |
| 2015/0054313 | A1 * | 2/2015 | Grace | A47C 7/70 | 297/45 |
| 2019/0313799 | A1 * | 10/2019 | Frankel | A47C 4/283 | |

* cited by examiner

*Primary Examiner* — Chi Q Nguyen

(74) *Attorney, Agent, or Firm* — Merek, Blackmon & Voorhees, LLC

(57) ABSTRACT

A type of two-person folding chair which includes a folding frame, seat area, and backrest area. The folding frame includes support sections on both sides in corresponding positions, and diagonal bar sets that connect the two support sections on both sides. Wherein, each support section includes a bar bent into an open D-shaped structure, which forms, from top to bottom, a backrest bar, an armrest bar, a front leg bar, and a landing bar. The diagonal bar set includes two or more diagonal bar units. The seat bars on the upper portions of the diagonal bar units support to form the seat area.

5 Claims, 4 Drawing Sheets

TWO-PERSON FOLDING CHAIR

BACKGROUND OF THE INVENTION

1. Field of the Invention

The present invention pertains to the field of folding chairs, particularly to a type of two-person folding chair. More specifically, it refers to a type of two-person folding chair that can be packed and folded up at left and right sides.

2. Description of the Prior Art

Most of the director chairs on the current market are produced by combining steel bars with a seat and backrest fabric, where the steel bars form the folding frame and the oxford fabric forms the seat and backrest areas. This design offers seat comfort and a folding feature. The prior Chinese patent CN200820145303.2 shows a type of director chair. It is a structure that consists of a folding frame and seat fabric. The inverted-U shaped vertical supporting bars on the left and right sides of the frame are joined together by two U-shaped connecting bars. The two ends of the two U-shaped connecting bars are mounted onto the two lower portions of the two supporting bars. The middle sections are crossed-joined, and the upper portions are respectively hinged to the middle section of the other supporting bar via the connecting piece. A reinforcement bar is connected to the area between the two ends of the connecting bar or the supporting bars. A backrest bar is connected to the upper portion on the back side of each of the two supporting bars. Between the two backrest bars is the seat fabric. The U-shaped connecting bar is formed by two overlapping and hinged horizontal L-shaped bars. The seat fabric is placed on the overlapping section of one of the horizontal L-shaped bars. The director chair is characterized by a tight fabric and a large seat area for the necessary supporting of the legs.

The subsequent Chinese patent CN201220187027.2 shows a type of folding director chair, which includes a folding frame and seat fabric. The folding frame includes a support section on both sides arranged in corresponding or symmetrical positions, and a diagonal bar set that connects the two support sections on both sides. The diagonal bar set drives the support sections on both sides to be opened and folded. The support section includes the front and rear support bars, the armrest bar, and the backrest bar that are affixed to the seat support bar. The seat support bar forms a rectangular-shaped closure with the front and rear support bars and the grounding bar to constitute the main support body. In addition, the armrest bar and the backrest bar are hinged on the seat support bar to form the structure to form a linkage mechanism. The seat fabric of the seat area is tightly fitted on the two seat support bars, and the backrest area is tightly fitted on the two backrest bars. Together they form a stable main body for seating.

In summary, the existing director chair frame features support bars on both sides, which is a rigid body made up of multiple bars. The folding frame is highly rigid, but all the existing director chairs are designed with the seating capacity of one person only. How to change the existing technology and improve current director chairs into two- or three-person chairs has become an object of the research of the present invention.

SUMMARY OF THE INVENTION

A purpose of this invention is to provide a type of two-person folding chair formed by a two-person support part which is bent by a rod and matched with a front and rear oblique rod coordinating and connecting the support sections at both sides.

The technical scheme of the invention is realized in part according to the following methods:

A two-person folding chair, including a folding frame, seat area, and backrest area.

The folding frame includes a support part with a corresponding or symmetrical arrangement on both sides, and a diagonal bar set that connects the two support sections on both sides. The diagonal bar set drives the support sections on both sides to be opened and folded.

This invention may have one or more of the following characteristics:

The support section comprises a bar bent into an open D-shaped structure, forming, from top to bottom, the backrest bar, the armrest bar, the front leg bar, and the landing bar.

The diagonal bar set consists of two parts, namely, the front set and the rear set. Each diagonal bar set comprises two or more diagonal bar units with X crossover hinges. The front and rear diagonal bar units correspond to each other. Seat bars are arranged at the upper portions of the corresponding front and rear diagonal bar units. The lower portions of the front diagonal bar unit at both sides are hinged to the front-leg bars or ground bars, whereas the upper portions are hinged to a connecting bar, and the other end of the connecting bar is hinged to the front-leg bar, pulling the support sections. The lower portions of the rear diagonal bar unit at both sides are hinged to the ground bars. A landing U-shaped bar is hinged to the lower portions of the middle parts of the said front and rear diagonal bar units. The landing U-shaped bar connects the middle portions of the front and rear corresponding diagonal bar units.

The seat area is formed by a seat fabric sleeved between the seat bars.

The backrest area is formed by a backrest fabric sleeved between the backrest bars.

The lower portions of the adjacent diagonal bar units in the front and rear diagonal bar sets are articulated with the landing U-shaped bar through a rivet, and a supporting plastic component is also articulated at the hinge point of the upper portions of the diagonal bar units. A seat bar is fixed on each side of the supporting plastic piece.

The backward portion of the landing U-shaped bar has a supporting section extending upward, and the supporting section supports and positions the backrest fabric at the middle part.

Further, the seat bars fixed on both sides of the front and rear supporting plastic components extend backwards, and a short bar is locked and fixed between the ends. The supporting portions of the landing U-shaped bars passes through a rear supporting plastic component to form a space together with the short bar. The back swing of the supporting portions is restrained by the short bar, and the force-bearing support is formed.

Further, the corresponding bar member in the front and rear diagonal bar units articulating the seat bars on both sides is a bipod portion of a U-shaped bar, and the U-shaped bottom portion of the U-shaped bar is locked and fixed together with the seat bars side by side.

Further, a position lock is arranged in the front portion of each of the seat bars at both sides. Each position locker is molded double-sided with two curved slots, including a horizontal slot, and a vertical slot. When opening, the vertical slot comes into contact with the front leg bar of the support section, creating a support structure for the rear portion of the front leg bar.

Compared to the existing single folding chairs, this invention has a more concise structure, an easier production process and a flexibility feature of support sections at both sides. The support sections cleverly use a bent bar to form an open D-shaped structure, organically creating backrest support and armrest support. When the human body leans backward, the bent backrest bars change shape slightly to provide flexibility. The seat area is tightened by the seat bars at the upper portions of the front and rear corresponding diagonal bar sets connecting the support sections at both sides, keeping the body in an upright and decorous manner.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

Similar reference characters denote corresponding features consistently throughout the attached drawings. Namely, in the drawings the following reference numbers refer to the following part.

Figure 1:
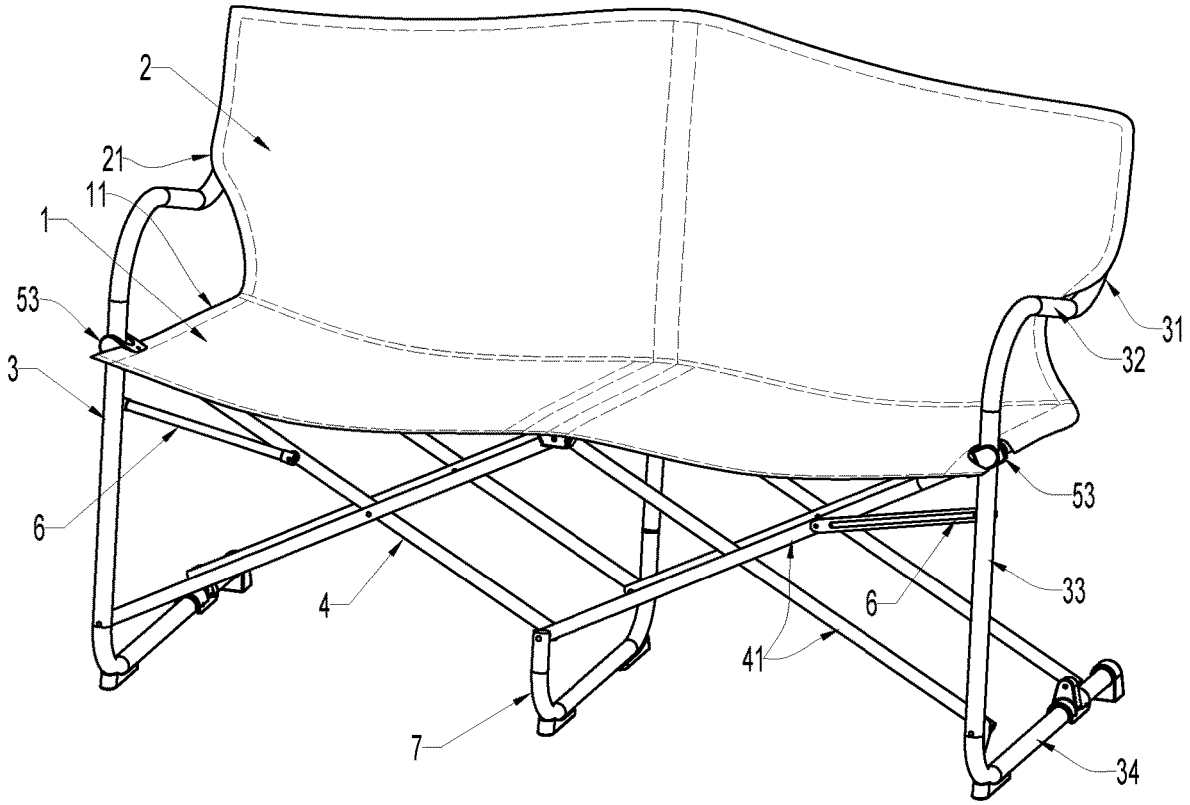
FIG. 1 is an illustration of the two-person folding chair.
Figure 2:
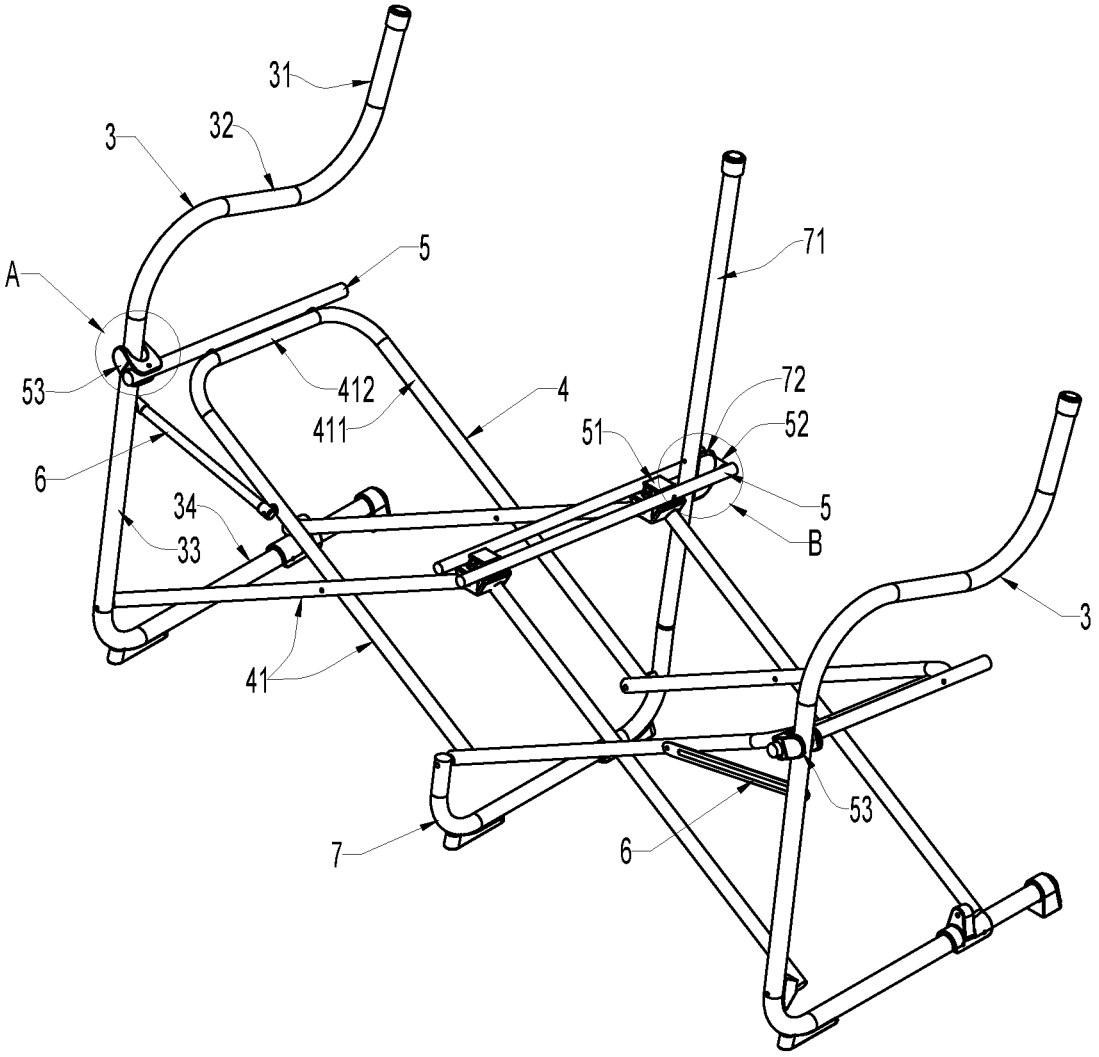
FIG. 2 is an illustration of the folding frame of the two-person folding chair.
Figure 3:
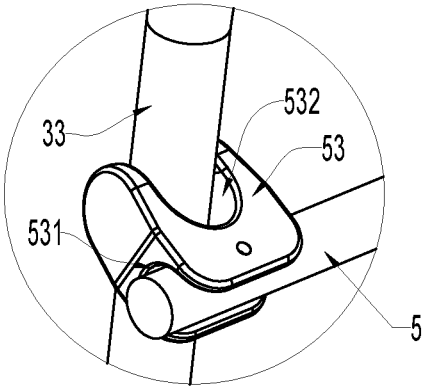
FIG. 3 shows a zoomed image of selection A from FIG. 2.
Figure 4:
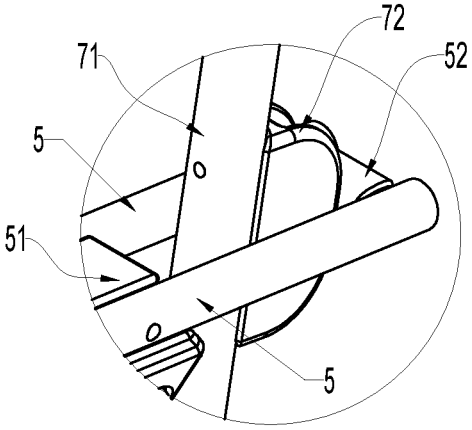
FIG. 4 shows a zoomed image of selection B from FIG. 2.
Figure 5:
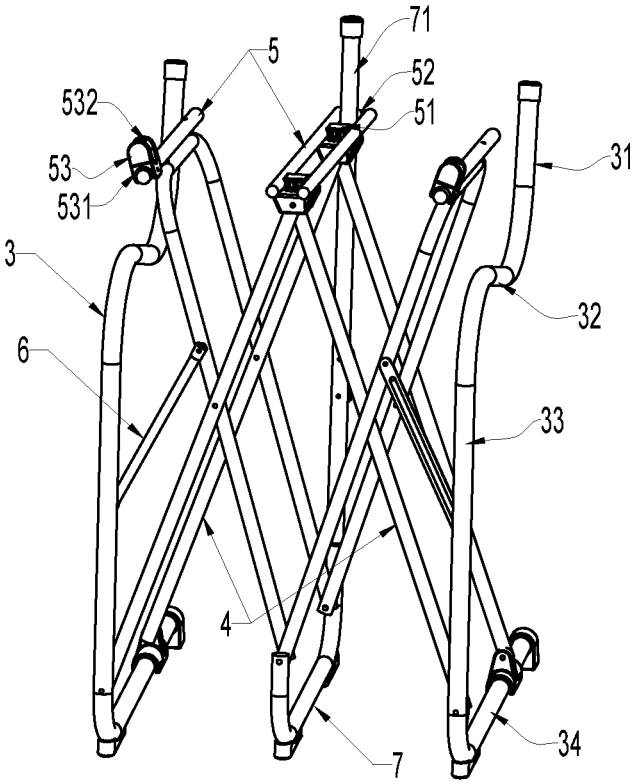
FIG. 5 is an illustration of the folding status of the folding frame of the two-person folding chair.
Figure 6:
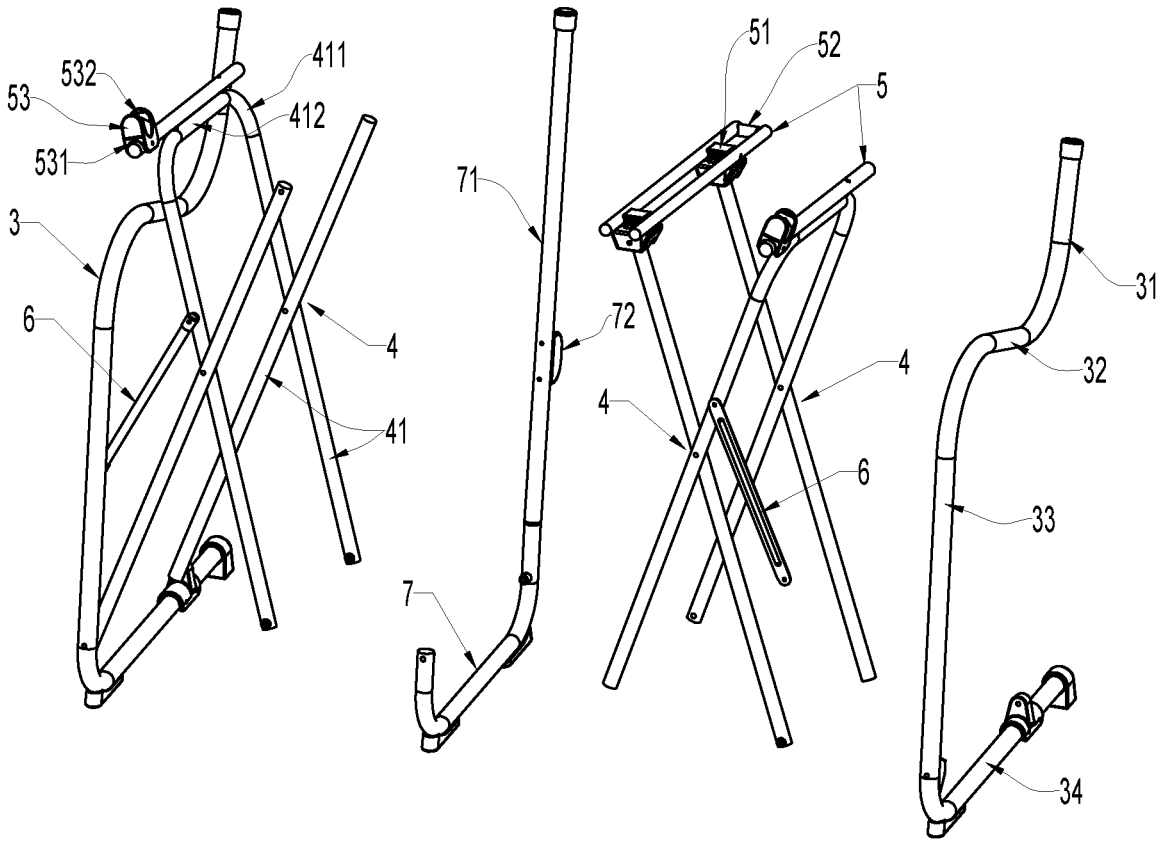
FIG. 6 is a breakdown illustration of the folding status of the folding frame of the two-person folding chair.

1—Seat Area
11—Seat Fabric
2—Backrest Area
21—Backrest Fabric
3—Support Section
31—Backrest Bar
32—Armrest Bar
33—Front Leg Bar
34—Landing Bar
4—Diagonal Bar Unit
41—Bar Members
411—U-shaped Bar
412—U-shaped Bottom Section
5—Seat Bar
51—Supporting Plastic Component
52—Short Bar
53—Position Locker
531—Horizontal Slot
532—Longitudinal Slot
6—Connecting Bar
7—Landing U-shaped Bar
71—Supporting Portion
72—Wedge Block Similar reference characters denote corresponding features consistently throughout the attached drawings.

DETAILED DESCRIPTION OF THE PREFERRED EMBODIMENT(S)

Referring now to FIGS. 1 to 6, the two-person folding chair includes a folding frame, a seat area 1 and a backrest area 2. The folding frame includes a support section 3 on both sides in corresponding or symmetrical positions, and a diagonal bar set that connects the two support sections on both sides. The diagonal bar set drives the support sections 3 on both sides to perform the closing and folding actions.

The support section 3 comprises a bar bent into an open D-shaped structure, forming, from top to bottom, the backrest bar 31, the armrest bar 32, the front leg bar 33, and the landing bar 34. As a complete product, attachments such as foot pads can be locked and fixed on the landing bar 34. The backrest bar 31 is used for tightening and supporting the backrest fabric 21, forming the backrest area 2.

The diagonal bar set consists of two parts: the front set and the rear set. Each diagonal bar set comprises two or more diagonal bar units 4 forming an X-shaped hinge joint, namely, each diagonal bar unit 4 is formed by X-shaped hinge joint of two bar members 41. The adjacent diagonal bar units in the same set are mutually hinged by the upper and lower portions of the bar members 41, forming the entire diagonal bar sets. The front and rear diagonal bar units 4 correspond to each other. Seat bars 5 are arranged at the upper portions of the corresponding front and rear diagonal bar units 4, in order to tighten and support the seat fabric 11, forming the seat area 1.

The lower portions of the front diagonal bar units 4 at both sides are hinged on the front leg bars 33 or landing bars 34, the upper portions connect a connecting bar 6, and the other end of the said connecting bar 6 is hinged on the front leg bars 33, pulling the support section 3. More specifically, the lower portions of the front diagonal bar units 4 at both sides are located below a bar member 41 and are hinged on the front leg bars 33 or landing bars 34, and the other bar member 41 is hinged with the connecting bar 6 at the upper part of the hinge joint. In the legend, due to the avoidance relationship between the bar members at the left and right sides, a connecting bar 6 is a round one, while the other connecting bar is of a sheet structure. The two connecting bars are in different shapes but have the same functions.

The lower portions of the rear diagonal bar units 4 at both sides are hinged on the landing bars 34, forming a three-point connection at the support sections 3 at both sides through the diagonal bar sets. A landing U-shaped bar 7 is hinged between the lower portions of middle parts of the front and rear diagonal bar units 4. The landing U-shaped bar 7 connects the middle parts of the front and rear corresponding diagonal bar units 4. More specifically, the lower portions of the adjacent diagonal bar units 4 in the front and rear diagonal bar sets are articulated with the landing U-shaped bar 7 through a rivet. A supporting plastic component 51 is also articulated at the hinge joint of the upper portions. A seat bar 5 is fixed at each of the two side of the supporting plastic component 51. A pair of seat bars 5 that are fixed at the two sides of the front and rear supporting plastic component extend backwards, and a short bar 52 is locked and fixed between the ends.

Further, the backward portion of the landing U-shaped bar 7 extends upwards as the supporting portion 71. The supporting portion 71 has a similar height as the backrest bars 31 at both sides or is 50 cm or less high than the backrest bars. The supporting portion 71 functions to support and position the backrest fabric 21 located at the middle part. Also, the supporting portion 71 of the landing U-shaped bar goes through a rear supporting plastic component 51 and constitutes a space together with a short bar 52, while the short bar 52 functions to restrain the back swing of the supporting portion 71 and forms a force-bearing support. In other words, the supporting portion 71 is restrained within a small space constituted by the rear supporting plastic component 51, the short bar 52 and the two seat bars 5, providing dynamic connecting and supporting functions. Furthermore, a wedge block 72 is locked and fixed on the rear side of the supporting portion 71. When the folding chair is opened in place, the wedge block 72 will come into contact with the short bar 52, eliminating gaps and obtaining reliable support. In the folding process, greater freedom can be obtained after leaving the short bar, reducing the resistance during folding.

Further, in order to increase the connection and rigid strength between the front and rear diagonal bar sets, the corresponding bar in the front and rear diagonal bar units in hinging the seat bars 5 at both sides is the bipod portion 411 of a U-shaped bar. The U-shaped bottom portion 412 of the U-shaped bar is locked and fixed side by side with the seat bar 5, which brings convenience to the production processing.

A position lock 53 is arranged in the front portion of each of the seat bars at both sides. Each position lock ("locker") 53 is molded double-sided with two curved slots, including a horizontal slot 531, and a vertical slot 532. The horizontal slot 531 functions to fit with the seat bar 5, which results convenient for stable locking and fixation of the position locker 53. During opening, the vertical slot 532 comes into contact with the front leg bar 33 of the support section, creating a support structure for the rear portion of the front leg bar 33, so as to enhance the connection between the support sections 3 at both sides and the seat area 1.

The seat area 1 is formed by seat fabric 11 sleeved between the seat bars 5. That is to say, the upper portion of each diagonal bar unit 4 is provided with an independent seat bar 5, forming relatively independent seat area 1, and preventing adjacent seat fabrics 11 from dragging each other due to bearing different forces.

The backrest area 2 is formed by the backrest fabric 21 sleeved between the backrest bars 31 and the supporting portions 71, which corresponds to each diagonal bar unit 4 and also forms an independent supporting structure. Furthermore, the joining parts between the seat fabric 11 and the backrest fabric 21 can be sewn together, as shown in FIG. 1. It also can adopt a separate structure; the backrest fabric 21 is designed for its upper part only, with its lower part hollowed out, forming a permeability function.

Taking the two-person folding chair as an example, a three-person or four-person folding chair can be formed by simply adding the corresponding oblique Rod Unit 4 to the front and rear tilt rod groups.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A two-person folding chair, including:

a folding frame, a seat area, and a backrest area;

the folding frame having two sides and including a support section on each of the two sides, a front diagonal bar set and a rear diagonal bar set for connecting the respective support section on each side of the folding frame together for driving the two support sections when the folding frame opens or closes;

each support section comprises a bar bent into an open d-shaped structure, forming, a backrest bar, an armrest bar, a front leg bar, and a landing bar;

the front diagonal bar set comprises two or more front diagonal bar units forming a front x-shaped hinge joint;

the rear diagonal bar set comprises two or more rear diagonal bar units forming a rear x-shaped hinge joint;

the front and rear diagonal bar units correspond to each other;

seat bars are arranged at upper portions of the corresponding front and rear diagonal bar units;

lower portions of the front diagonal bar unit at both sides are hinged to the front-leg bar or to the landing bar, whereas the upper portions are hinged to a connecting bar, and an other end of the connecting bar is hinged to the front-leg bar;

lower portions of the rear diagonal bar unit at both sides are hinged to the landing bar;

a landing U-shaped bar is hinged to lower portions of middle parts of the front and rear diagonal bar units;

the landing U-shaped bar connects middle portions of the front and rear corresponding diagonal bar units; and the seat area is formed by a seat fabric sleeved between seat bars;

the backrest area is formed by a backrest fabric sleeved between backrest bars;

lower portions of adjacent diagonal bar units in the front and rear diagonal bar sets are articulated with the landing U-shaped bar through a connector, and a supporting plastic component is articulated at a hinge point of the upper portions of the front and rear diagonal bar units; and a seat bar is fixed on each side of the supporting plastic component.

2. A two-person folding chair according to claim 1, wherein a backward portion of the landing U-shaped bar has a supporting section extending upward.

3. A two-person folding chair according to claim 2, wherein the seat bars fixed on each side of the supporting plastic component extend backwards;

a short bar is connected between ends of the seat bars;

the supporting portions of the landing U-shaped bars passes through the supporting plastic component to define a space together with the short bar; and backward swinging of the supporting portions is restrained by the short bar.

4. A two-person folding chair according to claim 3, wherein a corresponding bar member in the front and rear diagonal bar units articulating the seat bars on both sides is a bipod portion of a U-shaped bar, and the U-shaped bottom portion of the U-shaped bar is connected with the seat bars.

5. A two-person folding chair, including:

a folding frame, a seat area, and a backrest area;

the folding frame having two sides and including a support section on each of the two sides, a front diagonal bar set and a rear diagonal bar set for connecting the respective support section on each side of the folding frame together for driving the two support sections when the folding frame opens or closes;

each support section comprises a bar bent into an open d-shaped structure, forming, a backrest bar, an armrest bar, a front leg bar, and a landing bar;

the front diagonal bar set comprises two or more front diagonal bar units forming a front x-shaped hinge joint;

the rear diagonal bar set comprises two or more rear diagonal bar units forming a rear x-shaped hinge joint;

the front and rear diagonal bar units correspond to each other;

seat bars are arranged at upper portions of the corresponding front and rear diagonal bar units;

lower portions of the front diagonal bar unit at both sides are hinged to the front-leg bar or to the landing bar, whereas the upper portions are hinged to a connecting bar, and an other end of the connecting bar is hinged to the front-leg bar;

lower portions of the rear diagonal bar unit at both sides are hinged to the landing bar;

a landing U-shaped bar is hinged to lower portions of middle parts of the front and rear diagonal bar units;

the landing U-shaped bar connects middle portions of the front and rear corresponding diagonal bar units; and the backrest area is formed by a backrest fabric sleeved between backrest bars;

wherein a respective position locker is arranged in the front portion of each of the seat bars;

each position locker is molded double-sided with two curved slots, including a horizontal slot, and a vertical slot;

wherein during opening, the vertical slot comes into contact with the front leg bar of the support section, creating a support structure for the rear portion of the front leg bar.

* * * * *